US006294718B1

(12) United States Patent
Saunders, Jr. et al.

(10) Patent No.: US 6,294,718 B1
(45) Date of Patent: Sep. 25, 2001

(54) STRINGED MUSICAL INSTRUMENT TOP MEMBER

(75) Inventors: Robert H. Saunders, Jr., Glastonbury; Nicholas Ladutko, Simsbury, both of CT (US); Donald M. Johnson, Sandisfield, MA (US); Frank I. Untermyer, Weatogue, CT (US); William P. Vassilopoulos, Westfield, MA (US); Clifford Gunsallus, North Canton; William Hudak, Hebron, both of CT (US)

(73) Assignee: Kaman Music Corporation, Bloomfield, CT (US)

( * ) Notice: Subject to any disclaimer, the term of this patent is extended or adjusted under 35 U.S.C. 154(b) by 0 days.

(21) Appl. No.: 09/574,356

(22) Filed: May 19, 2000

(51) Int. Cl.[7] ..... G10D 3/00
(52) U.S. Cl. ..... 84/291; 821/290; 821/294
(58) Field of Search ..... 84/291, 290, 294, 84/189, 192

(56) References Cited

U.S. PATENT DOCUMENTS

| | | | | |
|---|---|---|---|---|
| 3,424,048 | * | 1/1969 | Mack et al. | 84/290 |
| 3,474,697 | | 10/1969 | Kaman | 84/267 |
| 3,699,836 | * | 10/1972 | Glasser | 84/291 |
| 3,880,040 | * | 4/1975 | Kaman | 84/291 |
| 4,056,034 | | 11/1977 | Kaman | 84/267 |
| 4,090,427 | * | 5/1978 | Kaman | 84/291 |
| 4,119,009 | | 10/1978 | Kaman, II | 84/293 |
| 4,145,948 | | 3/1979 | Turner | 84/293 |
| 4,172,405 | | 10/1979 | Kaman, II | 84/293 |
| 4,200,023 | | 4/1980 | Kaman | 84/293 |
| 4,201,108 | | 5/1980 | Bunker | 84/1.16 |
| 4,334,452 | | 6/1982 | Morrison, III et al. | 84/1.16 |
| 4,408,516 | | 10/1983 | John | 84/275 |
| 4,429,608 | * | 2/1984 | Kaman et al. | 84/291 |
| 4,539,886 | | 9/1985 | Hoffart | 84/267 |
| 4,616,548 | | 10/1986 | Anderson | 84/1.16 |
| 4,829,870 | | 5/1989 | Ralston | 84/291 |
| 4,873,907 | * | 10/1989 | Decker, Jr. et al. | 84/291 |
| 4,890,529 | | 1/1990 | Grant | 84/291 |
| 4,969,381 | | 11/1990 | Decker, Jr. et al. | 84/291 |
| 4,989,491 | | 2/1991 | Baggs | 84/723 |
| 5,170,000 | | 12/1992 | Hayashida et al. | 84/192 |
| 5,171,616 | * | 12/1992 | Dejima | 428/22 |
| 5,171,926 | | 12/1992 | Besnainou et al. | 84/275 |
| 5,189,235 | | 2/1993 | Fishman et al. | 84/291 |
| 5,218,149 | | 6/1993 | Tanaka et al. | 84/291 |
| 5,333,527 | * | 8/1994 | Jane et al. | 84/291 |
| 5,396,823 | | 3/1995 | Hoshino | 84/291 |
| 5,406,874 | | 4/1995 | Witchel | 84/291 |

(List continued on next page.)

OTHER PUBLICATIONS

Guitar Gear Edited by John Brosh, William Morrow & Co. Inc 105 Madison Ave. New York, NY 10016, 1985.*

*Primary Examiner*—Shih-Yung Hsieh
(74) *Attorney, Agent, or Firm*—McCormick, Paulding & Huber LLP

(57) ABSTRACT

A top member for the body of an acoustical stringed instrument includes a forward part having an interior portion spaced inwardly from the side wall of the body after the top member has been assembled to the body, the interior portion having a pair of composite material layers with a core layer bonded therebetween. The forward part further has a core free flex edge portion which borders the outer periphery of the interior portion, and is made by having the pair of composite material layers bonded in contact with each other. A skirt projects rearwardly from the rear surface of the flex edge portion and extends along the edge of the flex edge portion. When its top member is assembled with the body, the skirt slidably fits over the sidewall of the body.

28 Claims, 4 Drawing Sheets

U.S. PATENT DOCUMENTS

| | | | | |
|---|---|---|---|---|
| 5,461,958 | | 10/1995 | Dresdner et al. | 84/267 |
| 5,537,906 | | 7/1996 | Steinberger | 84/291 |
| 5,682,003 | | 10/1997 | Jarowsky | 84/267 |
| 5,691,491 | | 11/1997 | DeGomez | 84/291 |
| 5,747,711 | | 5/1998 | Cavaness et al. | 84/291 |
| 5,811,703 | | 9/1998 | Hoshino | 84/267 |
| 5,895,872 | | 4/1999 | Chase | 84/291 |
| 5,911,168 | | 6/1999 | Enserink | 84/291 |
| 5,945,614 | | 8/1999 | White | 84/267 |
| 5,955,688 | * | 9/1999 | Cook | 84/291 |
| 6,034,309 | * | 3/2000 | Teel et al. | 84/291 |
| 6,107,552 | * | 8/2000 | Coomar et al. | 84/291 |

* cited by examiner

STRINGED MUSICAL INSTRUMENT TOP MEMBER

FIELD OF THE INVENTION

The present invention relates generally to stringed musical instruments of the kind having a hollow body and a neck, such as guitars. More specifically, the present invention relates to a top member for the body of the instrument and to a method of making the same.

CROSS-REFERENCE TO RELATED APPLICATIONS

Some of the material disclosed herein is disclosed and claimed in the following U.S. Patent Application entitled "Stringed Musical Instrument Body and Neck Assembly", which is hereby incorporated by reference and filed concurrently herewith.

BACKGROUND OF THE INVENTION

One of the most important elements in traditional high quality guitars of the type described generally above is the sound board portion of the top member. Vibrations from the strings are transmitted to the sound board and through the bridge. Therefore, the construction of the sound board has a great deal of influence on the overall acoustic performance of the guitar.

In classical guitars, fine grained soft woods, e.g., spruce, red cedar or red wood, are frequently used as a sounding board material for their exquisite tonal and visual qualities. However, wooden instruments are inherently vulnerable to the elements, particularly humidity, moisture and heat. The stiffness of a wood sounding board may vary with changes in humidity. For example, wood sounding boards are subject to sinking, or transversing inward, bowing, creeping, or developing ripples under conditions of high humidity and deforming under string tension. The tendency of wood to crack under hot, dry conditions introduces further problems. Since the physical characteristics of wood vary, it is difficult to manufacture instruments which have uniform sound producing qualities.

Also, separate structural reinforcements, e.g., braces and neck blocks, must generally be provided to compensate for string tension in wood instruments. The braces are also used to distribute the string vibrations received by the bridge over the top member and to supply structural reinforcement to the areas near any sound holes located in the top member. These reinforcements add considerably to the manufacturer's cost and weight of such an instrument, and are known to affect the tone.

To compensate for many of the problems associated with wood instruments, it has been proposed in the past to make top members and other guitar components of composite materials. The term "composite materials" means materials made chiefly of two or more weather resistant non-wood components, such as carbon fibers embedded in an epoxy resin matrix with the fibers either being arranged randomly, unidirectionally or woven into a fabric. However, sound board portions of composite material top members often do not have the same desirable tonal and other response qualities as wooden sound boards.

In attempts to address this problem some prior art composite top members utilize a laminated construction having at least a pair of composite material layers with a core layer of wood, or perhaps some other material, e.g., an aramid material, bonded between. (Aramids are defined by the Merriam-Webster Collegiate Dictionary, and for purposes of this application, as any of a group of lightweight but very strong heat-resistant synthetic aromatic polyamide materials that are fashioned into fibers, filaments, or sheets and used especially in textiles and plastics.) The more freely the core layer is allowed to vibrate, the better the tonal quality of the instrument and the more closely the sound board portion simulates the acoustical performance of wood. However, in prior laminated sound boards with wooden or other core layers, the core layer extends all the way to the sidewall of the instrument body, so that adjacent the sidewalls, the composite material layers clamp against the core layer and restrict core vibrations in much the same way a vibrating cymbal would be restricted if held by its outer edges.

Moreover, to reduce weight, prior laminated composite top members are often manufactured from relatively thin material. As a result, the top member is initially flexible and a considerable number of braces are required to supply structural reinforcement to the top member, especially in areas near any sound hole or holes located in the sound board.

There is, therefore, a need for an improved top member for the body of an acoustical or acoustical/electric stringed instrument.

SUMMARY OF THE INVENTION

The present invention offers advantages and improved alternatives over the prior art by providing a top member having a generally flat forward part for a hollow bodied stringed instrument, such as a guitar, which utilizes a laminated construction. An interior portion (sound board portion) of the forward part, that is a portion spaced from the sidewalls of the instrument body, includes a pair of composite material layers with a core layer bonded between the composite material layers. A core free flex edge portion surrounds the interior portion and allows the interior portion to vibrate significantly more freely than prior art laminated sound boards for an improved acoustical performance. Additionally, a rearwardly projecting skirt and rearwardly projecting sound hole flanges provide substantial structural reinforcement for the top member when assembled to the body. It also significantly reduces the amount of bracing required relative to prior art top members. The skirt also allows the top member to be assembled with the sidewalls of the instrument body in a single, efficient and attractive appearance providing way.

The invention also resides in that the top member is made for use with an instrument body having, a sidewall with an outer surface generally perpendicular to the forward part, in that the flex edge portion of the forward part has an outer edge and an inner surface, and in that the skirt projects rearwardly from the inner surface of the flex edge portion and extends along the edge of the flex edge portion. Further, the skirt has a laterally inward facing surface which is generally perpendicular to the forward part, and which is adapted to slidably fit over the outer surface of the body sidewall during assembly of the top member with the sidewall, thereby making unnecessary auxiliary mounting rings, lining strips or other components customarily used for attaching a top member to sidewalls.

A further feature of the invention resides in that the core layer of the interior portion has at least one opening defining the border of a sound hole and in that adjacent the sound hold border, the pair of composite material layers are bonded in contact with each other and are bent so as to form a flange projecting rearwardly from the rear surface of the interior portion to reinforce the interior portion near the sound hole. Additionally braces that are used are co-cured to the inner surface of the interior portion in a unique method of making the top member.

Further features and advantages of the invention will be apparent from the following detailed description of the preferred embodiment of the invention, and from the accompanying drawings and claims.

DETAILED DESCRIPTION OF THE PREFERRED EMBODIMENTS

Figure 1:
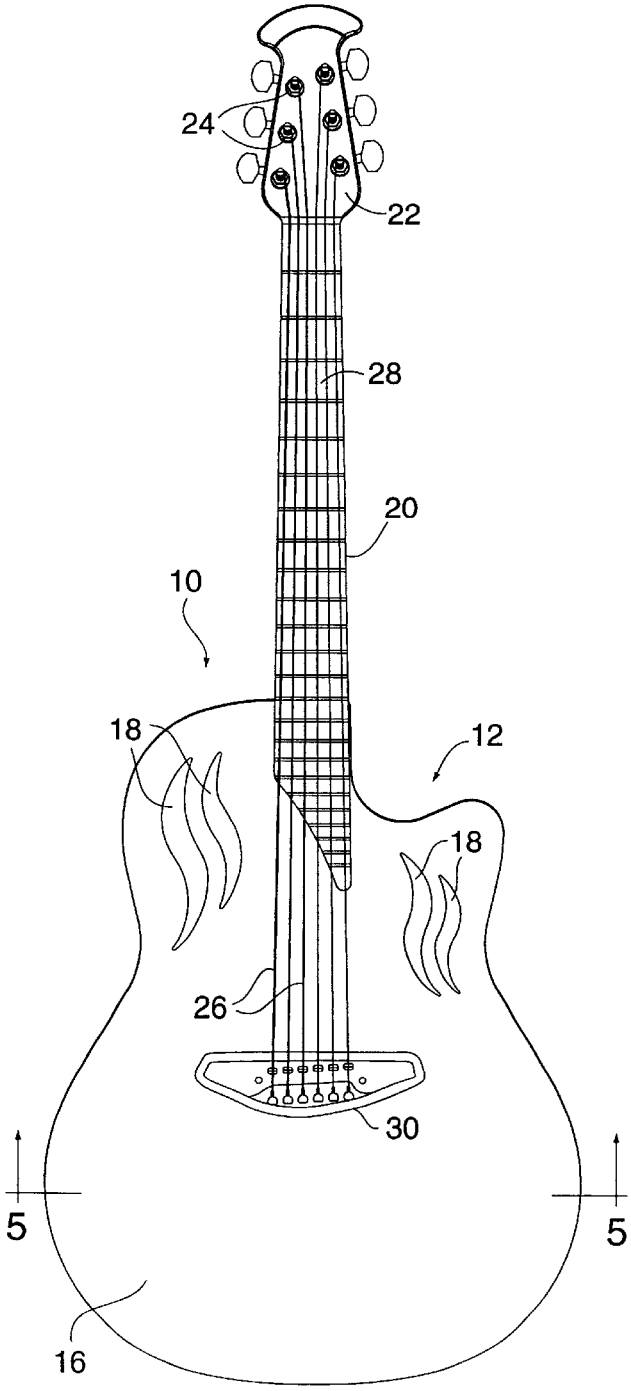
FIG. 1 is a plan view of a guitar constructed in accordance with the present invention.
Figure 2:
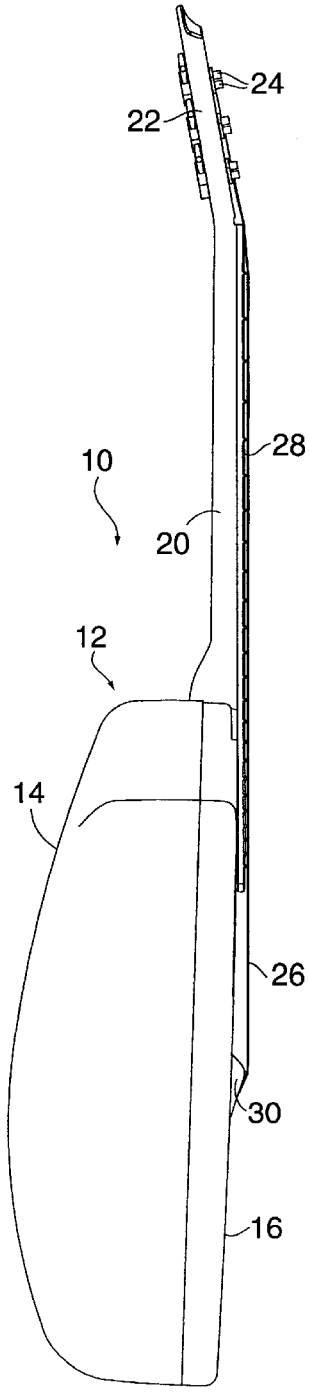
FIG. 2 is a side view of the guitar of FIG. 1.

Referring to FIGS. 1 and 2, a guitar 10 embodying the invention includes a hollow body 12 having a bowl-shaped back member (bowl) 14 and a relatively thin top member 16 with four sound holes 18 extending there through. Extending upwardly from the body 12 is an elongated neck 20 terminating in a peghead 22 provided with machine heads 24 for six strings 26, and carrying a fret board 28 disposed on its forward face. The strings 26 extend between the peghead 22 and a bridge 30 secured to the top member 16.

As used herein, and in the claims which follow, the relative terms "upper", "lower", "forward", "rear" and their derivatives are used with the instrument in question assumed to be oriented as shown in FIG. 1, i.e., with its peghead uppermost, with its neck generally vertical, and with its top member facing the viewer.

Figure 3:
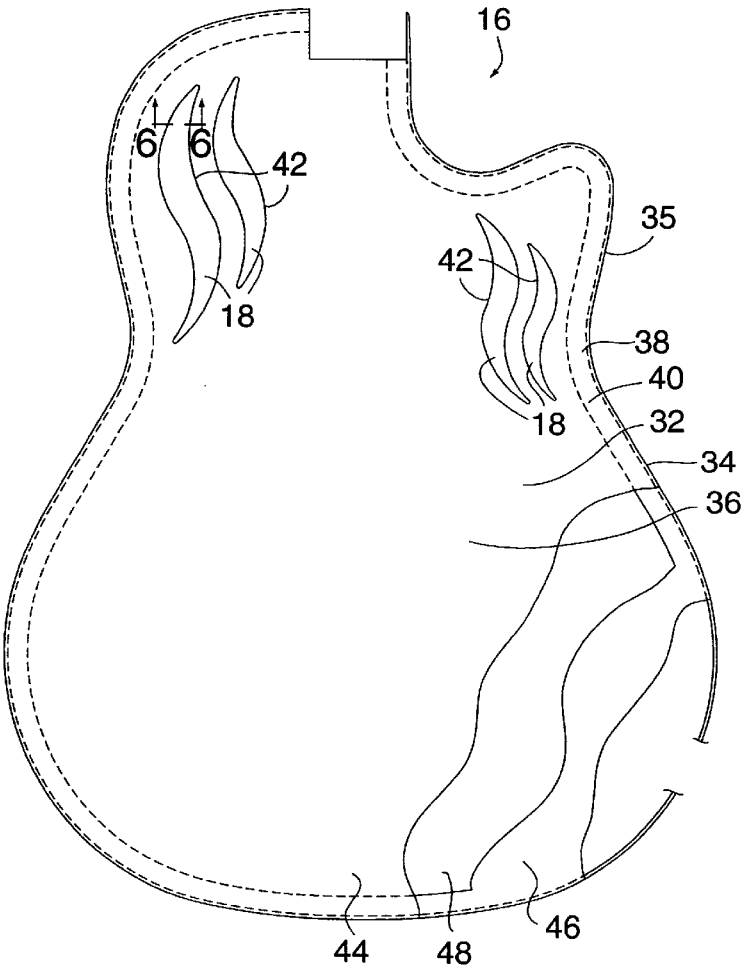
FIG. 3 is plan view of the top member of FIG. 1 partially cut away.
Figure 4:
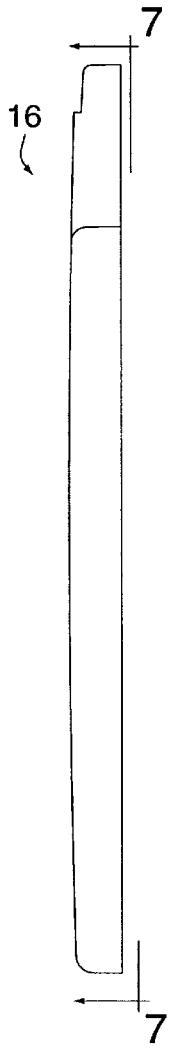
FIG. 4 is a side view of the top member of FIG. 3.

As shown in FIGS. 3 and 4, the top member includes a flat forward part 32, and a skirt 34 extending along the outer edge 35 of the forward part 32 and projecting rearwardly therefrom. The forward part 32 has an interior portion 36, i.e., sound board portion, and a flex edge portion 38 extending along the outer periphery 40 of the interior portion. The interior portion 36 also includes four sound holes 18 having boarders 42.

The interior portion 36 of the forward part 32 includes an outer composite material layer 44 and an inner composite layer 46 with a core layer 48 bonded between the inner and outer layers 44 and 46. The composite material layers 44 and 46 may each be made of various fiber reinforcing materials embedded in a suitable matrix of resin material, but preferably are each made of a woven fabric of carbon fibers embedded in an epoxy resin such as EPON 826. The core layer 48 is preferably a wood layer, but may also be composed of other suitable material, such as an aramid material.

Figure 5:
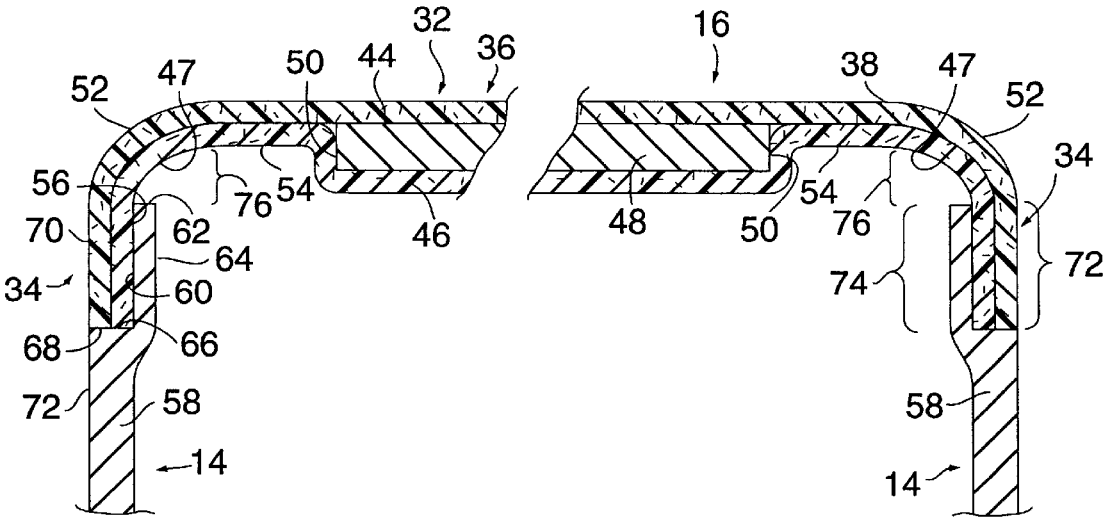
FIG. 5 is a cross-sectional view of the top member taken along the line 5—5 of FIG. 1.

Referring to FIG. 5, the composite material layers 44 and 46 extend outboardly from the outer periphery 50 of the interior portion 36 and are bonded in contact with each other to form the core free flex edge portion 38 of the forward part 32. As will be discussed in greater detail hereinafter, the interior portion 36 has an inner surface 80 from which a plurality of straight braces 82 project rearwardly (best seen in FIGS. 7 and 8). The flex edge portion 38 has an outer edge 52 and an inner surface 54. The skirt 34 of the top member 16 is a further extension of the bonded composite layers 44 and 46, which is curved at a predetermined radius of curvature 47 so as to project rearwardly from the inner surface 54, and which extends along the outer edge 52 of the flex edge portion 38. The predetermined radius of curvature 47 is preferably within about a range of ⅜ to ¾ inches. The skirt 34 has a laterally inward facing surface 56, which is generally perpendicular to-the forward part 32. The bowl 14 of the body 12 has a body sidewall 58 with an outer surface 60, which is generally perpendicular to the forward part 32. The inwardly facing surface 56 of the skirt 34 is adapted to slidably fit over the outer surface 60 of the body sidewall 58 upon assembly of the top member 16 to the bowl 14.

The body sidewall 58 includes a forward edge 62. Adjacent the forward edge 62 the body sidewall 58 is laterally inwardly stepped to provide an inwardly stepped wall portion 64 and a forwardly facing shoulder 66 located rearwardly of the forward edge 62. The skirt 34 includes a rear edge 68 adapted to abut the shoulder 66 when the top member 16 is fitted onto the body sidewall 58. Additionally, the skirt 34 includes a laterally outwardly facing side surface 70 which is positioned substantially flush with the outer surface 72 of the sidewall 58, rearwardly the shoulder 66 after the top member 16 has been assembled with the sidewall 58.

The skirt 34 projects rearwardly from the inner surface 54 of the flex edge portion 38 by a distance greater than the distance 74 between the shoulder 66 and the forward edge 62 of the sidewall 58. This provides a gap 76 between the inner surface 54 of the flex edge portion 38 and the forward edge 62 of the body sidewall 58 when the rear edge 68 of the skirt 34 abuts the shoulder 66.

In the guitar 10, when the strings 26 are strummed, acoustical vibrations, i.e., sound waves, are transmitted through the bridge 30 to the interior portion 36 of the top member 16. Due to the inherent flexibility of the flex edge portion 38 the interior portion 36 is not rigidly held at its outer periphery 50 as compared to sound boards of prior guitars, and therefore it vibrates more freely. Moreover, the gap 76 between the inner surface 54 of the flex edge portion 38 and the forward edge 62 of the body sidewall 58 substantially reduces structural restrictions to the vibrating movements of its flex edge portion 38 and interior portion 36. The resulting relatively unrestricted freedom of the interior portion 36 to respond to the exciting vibrations of the strings thereby significantly improves the overall tonal, dynamic, sustain and other acoustic characteristics of the guitar 10 relative to the prior guitars.

Figure 6:
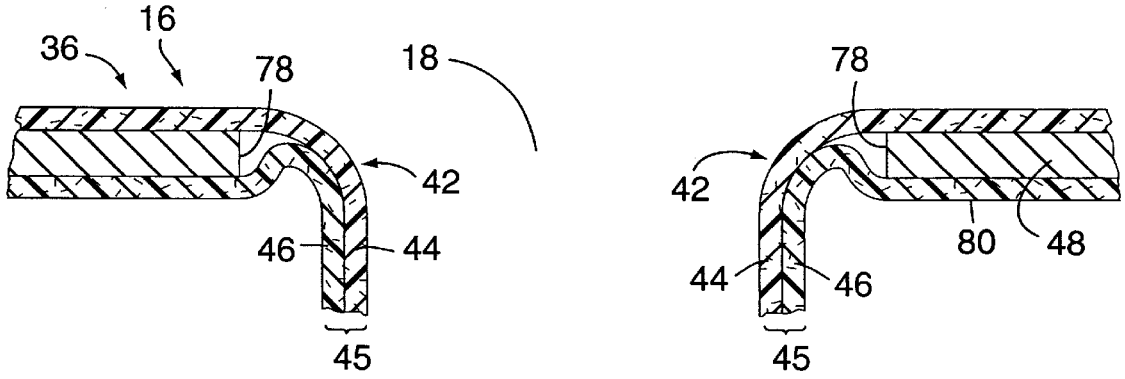
FIG. 6 is a cross-sectional view of the sound hole through the interior portion of the top member taken along the line 6—6 of FIG. 3.

Referring to FIG. 6, the interior portion 36 of the top member 16 has a sound hole periphery 78, and the pair of composite layers 44 and 46 extend inboardly of the periphery 78 to form the flange 45. That is, the composite layers 44 and 46 inboard of the sound hole periphery 78 are bonded in contact with each other and project rearwardly from the inner surface 80 of the interior portion 36 to provide the flange 45 which reinforces the interior portion 36 in the region of the sound hole 18. In operation, the structural reinforcement provided by the sound hole flanges 45 reduces the need for bracing and thereby provides improved acoustical performance.

Figure 7:
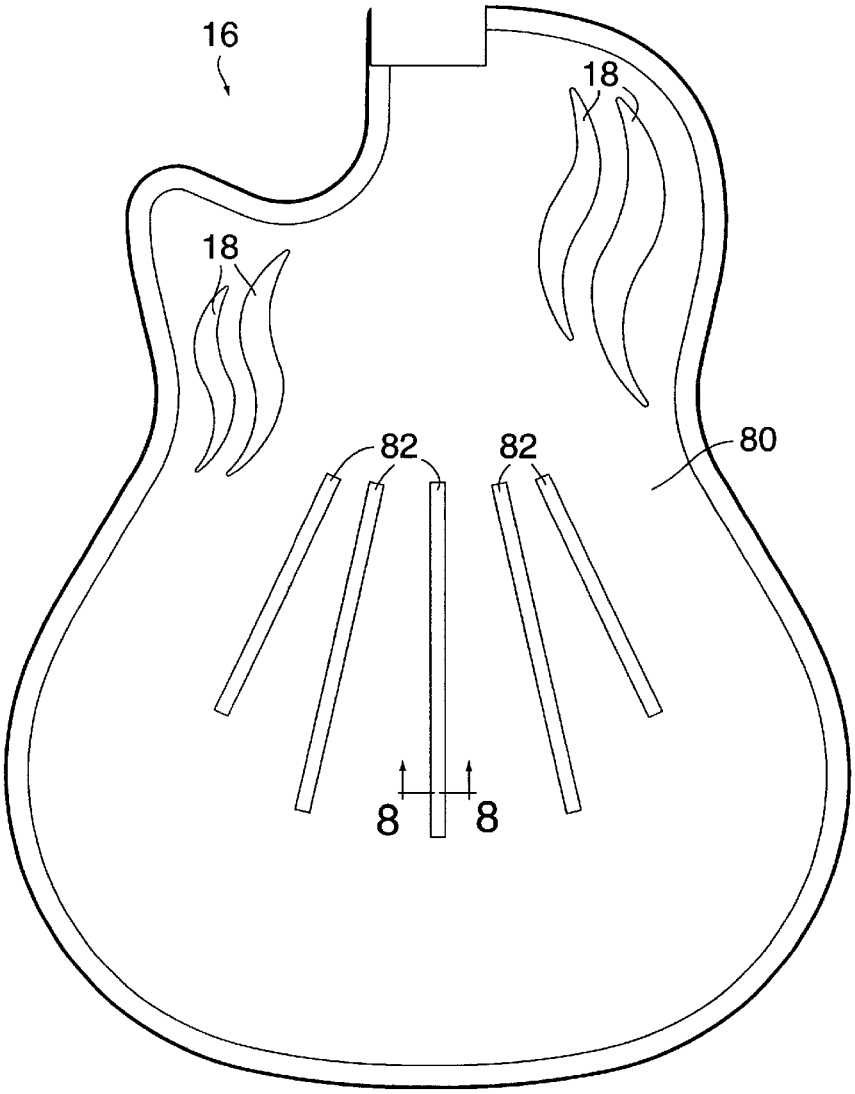
FIG. 7 is a bottom view of the top member taken along the line 7—7 of FIG. 4.

Referring to FIG. 7, a plurality of straight braces 82 project rearwardly from the inner surface 80 of the interior portion 36. Though the braces 82 are shown in a fan like pattern in this embodiment, other brace patterns, e.g., a vertical pattern, or combinations of patterns may be used and may also include cross braces. Additionally, other brace shapes, e.g. circular, may be used. The braces 82 are preferably made of graphite fiber fabric in a resin matrix, or unidirectional graphite fibers in a resin matrix, and/or combination of graphite fabric and unidirectional graphite in a resin matrix. Other materials, e.g., fiberglass or aramid, may be used as well.

Figure 8:
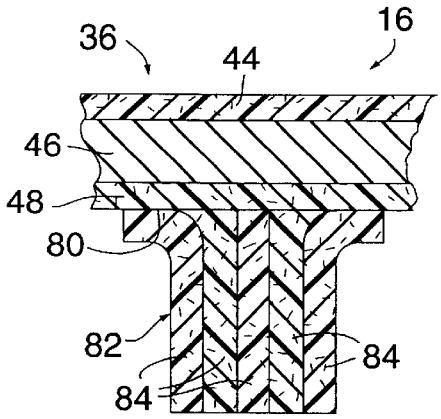
FIG. 8 is a cross-sectional view of a typical brace taken along the line 8—8 of FIG. 7.

Referring to FIG. 8, the braces 82 each include a plurality of composite layers or plies 84 laminated together and co-cured with the composite material of the top 16 to bond the braces 82 to the inner surface 80 of the interior portion 36. The number of plies 84 and the type of brace stack-up, fabric and/or unidirectional fibers, and shape is predetermined by the desired tonal qualities of the guitar 10.

As will be described in greater detail hereinbelow, several manufacturing processes may be used to co-cure the braces 82 and the top member 16, e.g., vacuum/oven, autoclave, and resin transfer molding. Production quantity, cost, and schedule can determine the process selection. A low rate production may perhaps use a vacuum/oven process to limit investment in capital equipment and non-recurring tooling. High volume production may perhaps use a vacuum/autoclave or resin transfer molding process; justifying investment in capital equipment and non-recurring tooling.

In a vacuum/autoclave process or a vacuum/oven process, each individual brace ply 84 is precut to a specific geometric shape on one type of equipment or by hand using templates and razor blade type instruments. They are pre-plied in specific sequence and then positioned on the inner surface 80 of the uncured inner composite layer 46 that has been laid into a prepared female mold. Mandrels for applying pressure and maintaining brace net shape during cure are installed, additional elastomeric mandrels are placed into the laid up assembly, and the entire assembly is then covered with release film. The assembly is vacuum bagged and cured in an oven or in an autoclave.

In a resin transfer molding process, all fabric and unidirectional graphite fibers are generally dry (not pre-impregnated with resin) or they may be tackified to maintain shape after the preforming operation has been completed. In special areas requiring peculiar sound attenuation, pre-impregnated graphite fabric and/or unidirectional pre-impregnated graphite fibers are inter-leafed into the dry laminate. Initially, graphite materials are precut in similar manner as previously described, laid into a mold and compacted under heat and vacuum resulting in a pre-form. The pre-form is then trimmed to a net configuration and loaded into a resin transfer mold containing a pre-compacted top assembly. A low viscosity resin is injected into the pre-form with vacuum. A hot oil heated self contained press is then used to co-cure the braces and the top assembly. A platen press can also be used to constrain mold pressure during resin transfer process.

The co-cured brace/top assembly is removed from the mold and deflashed. Trimming is limited to areas requiring clearances and access to subsequent bowl/neck assembly operations.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A top member for a body of an acoustical stringed instrument, the top member comprising:

a forward part having an interior portion spaced inwardly from a side wall of the body after the top member has been assembled to the body, the interior portion having a pair of composite material layers with a core layer bonded therebetween; and the forward part further having a core free flex edge portion bordering an outer periphery of the interior portion, the flex edge portion having at least one of the composite material layers.

2. The top member of claim 1 wherein, in the flex edge portion of the forward part, both of the pair of composite material layers are presented and are bonded in contact with each other.

3. The top member of claim 1 for the body of an acoustical stringed instrument wherein the side wall of the body has an outer surface generally perpendicular to the forward part of the top member, wherein:

the flex edge portion has an outer edge and an inner surface, and the top member further comprises a skirt projecting rearwardly from the inner surface of the flex edge portion of the forward part and extending along the edge of the flex edge portion, the skirt having a laterally inward facing surface which is generally perpendicular to the forward part, the inwardly facing surface being adapted to slidably fit over the outer surface of the body sidewall during an assembly of the top member with the sidewall.

4. The top member of claim 3 wherein the top member is curved at a predetermined radius of curvature so as to project the skirt rearwardly from the inner surface.

5. The top member of claim 4 wherein the predetermined radius of curvature is within a range of about ⅜ to ¾ inches.

6. The top member of claim 3 wherein the skirt further comprises the core free pair of composite material layers bonded in contact with each other.

7. The top member of claim 6 for a body wherein the sidewall of the body has a forward edge and adjacent the forward edge is inwardly stepped to provide an inwardly stepped wall portion and a forwardly facing shoulder located rearwardly of the forward edge, wherein the skirt has:

a rear edge adapted to abut the shoulder when the top member is fitted onto the body sidewall, and a laterally outwardly facing side surface which is positioned substantially flush with the outer surface of the sidewall rearwardly of the shoulder after the top member has been assembled with the sidewall.

8. The top member of claim 6 wherein the skirt projects rearwardly a distance from the inner surface of the flex edge greater than the distance between the shoulder and the forward edge of the sidewall to provide a gap between the inner surface of the flex edge and the forward edge of the body sidewall when the rear edge of the skirt abuts the shoulder.

9. The top member of claim 1 wherein the interior portion includes a sound hole defined by a core free sound hole border, the sound hole border having the pair of composite material layers bonded in contact with each other and projecting rearwardly from the inner surface of the interior portion to reinforce the interior portion near the sound hole.

10. The top member of claim 1 further comprising a plurality of reinforcing braces projecting rearwardly from the inner surface of the interior portion, the braces each including a plurality of composite material layers laminated together and co-cured with the composite material of the top member to bond the braces to the inner surface of the interior portion.

11. The top member of claim 1 wherein the core layer further comprises a wood core layer.

12. The top member of claim 1 wherein the pair of composite material layers further comprises graphite fabric impregnated with an epoxy resin.

13. A top member for the body of an acoustical stringed instrument wherein the body has a sidewall with an outer surface, the top member comprising:

a forward part generally perpendicular to the body side wall, the forward part having at least a pair of composite material layers with a core layer bonded therebetween, the forward part including an outer edge and an inner surface; and a core free skirt having the pair of composite material layers bonded in contact with each other and projecting rearwardly from the inner surface of the forward part and extending along the edge of the forward part, the skirt having a laterally inward facing surface which is generally perpendicular to the forward part, the inwardly facing surface being adapted to sidably fit over the outer surface of the body sidewall during an assembly of the top member with the sidewall.

14. The top member of claim 13 for a body wherein the sidewall of the body has a forward edge and adjacent the forward edge is inwardly stepped to provide an inwardly stepped wall portion and a forwardly facing shoulder located rearwardly of the forward edge, wherein:

the skirt has:

a rear edge adapted to abut the shoulder when the top member is fitted onto the body sidewall, and a laterally outwardly facing side surface which is positioned substantially flush with the outer surface of the sidewall rearwardly of the shoulder after the top member has been assembled with the sidewall.

15. A method for making a top member for a body of an acoustical stringed instrument, the method comprising:

disposing a first layer of composite material having a first layer boundary in a prepared mold;

disposing a core layer having an outer periphery upon the first layer;

disposing a second layer of composite material having a second layer boundary upon the core layer, wherein the first and second layer boundaries extend outboardly the core layer periphery forming a laid up assembly having a core free portion bordering the outer periphery of the core layer;

covering the laid up assembly with release film;

applying heat and pressure to cure the composite layers and core together, and to provide the top member which includes, a forward part having an interior portion spaced inwardly from the side wall of the body after the top member has been assembled to the body, the interior portion having the composite material layers with the core layer bonded therebetween, and the forward part further having a core free flex edge portion bordering an outer periphery of the interior portion, the flex edge portion having the composite layers bonded in contact with each other.

16. The method of claim 15 further comprising:

forming a substantially 90 degree bend in an outer edge portion of the core free portion of the laid up assembly to provide a skirt; and applying heat and pressure to cure the composite layers and core together, and to provide the top member, wherein the flex edge portion has an outer edge and an inner surface, and the skirt projects rearwardly from the inner surface of the flex edge portion and extends along the edge of the flex edge portion.

17. The method of claim 15 further comprising:

cutting the core layer for a sound hole to provide a core sound hole periphery;

cutting and pressing the composite layers inboard the core sound hole periphery together to form a sound hole flange; and bending the sound hole flange substantially 90 degrees along the sound hole periphery so as to project rearwardly from the interior portion.

18. The method of claim 15 further comprising:

precutting individual brace plies of composite material to a specific geometric shape;

stacking the plies in a specific sequence upon the second layer to form a plurality of braces projecting from the second layer;

installing mandrels over the braces to form the laid up assembly;

covering the laid up assembly with release film; and vacuum bagging the assembly to provide pressure.

19. The method of claim 18 wherein the first layer, the second layer and the braces further comprise graphite fabric pre-impregnated with an epoxy resin.

20. The method of claim 18 wherein the braces further comprise unidirectional graphite pre-impregnated fibers.

21. The method of claim 15 wherein the heating further comprises heating the bagged assembly in an oven.

22. The method of claim 15 wherein the heating further comprises heating the bagged assembly in an autoclave.

23. A method for making a top member for a body of an acoustical stringed instrument, the method comprising:

disposing a first layer of dry graphite fabric having a first layer boundary in a prepared mold;

disposing a core layer having an outer periphery upon the first layer;

disposing a second layer of dry graphite fabric having a second layer boundary upon the core layer, wherein the first and second layer boundaries extend outboardly the core layer periphery forming a laid up assembly having a core free portion bordering the outer periphery of the core layer;

compacting the first layer, second layer and core under heat and pressure to form a pre-compacted top assembly;

loading the pre-compacted top assembly into a resin transfer mold;

injecting a low viscosity resin into the mold;

applying heat and pressure to cure the pre-compacted top assembly to form a top assembly; and de-flashing the top assembly to provide the top member which includes, a forward part having an interior portion spaced inwardly from the side wall of the body after the top member has been assembled to the body, the interior portion having the composite material layers with the core layer bonded therebetween, and the forward part further having a core free flex edge portion bordering an outer periphery of the interior portion, the flex edge portion having the composite layers bonded in contact with each other.

24. The method of claim 23 further comprising:

precutting individual brace plies of dry graphite into a specific geometric shape;

layering the plies together to form a laminate;

compacting the layered plies in a mold under heat and pressure to form a brace pre-form;

trimming the brace pre-form to a specific geometric shape;

loading the brace pre-form into the resin transfer mold containing the pre-compacted top assembly;

applying heat and pressure to cure the brace pre-form and the pre-compacted top assembly to form a co-cured brace/top assembly; and de-flashing the co-cured brace/top assembly to provide the top member.

25. The method of claim 24 wherein the dry graphite is selected from the group consisting of graphite fabric and unidirectional graphite fibers.

26. The method of claim 24 layering further comprises inter leafing the plies with one of pre-impregnated graphic fabric and unidirectional graphite pre-impregnated fibers.

27. The method of claim 24 wherein the step of applying heat and pressure to cure comprises applying a hot oil press to co-cure the brace pre-form and the pre-compacted top assembly.

28. The method of claim 24 wherein the step of applying heat and pressure to cure comprises applying a platen press to co-cure the brace pre-form and the pre-compacted top assembly.

* * * * *